US005286162A

United States Patent [19]

Veres

[11] Patent Number: 5,286,162

[45] Date of Patent: Feb. 15, 1994

[54] METHOD OF REDUCING HYDRAULIC INSTABILITY

[75] Inventor: Joseph P. Veres, Westlake, Ohio

[73] Assignee: The United States of America as represented by the Administrator of the National Aeronautics and Space Administration, Washington, D.C.

[21] Appl. No.: 163

[22] Filed: Jan. 4, 1993

[51] Int. Cl.[5] ..... F04D 29/68

[52] U.S. Cl. ..... 415/115; 415/206; 415/914

[58] Field of Search ..... 415/115, 206, 914

[56] References Cited

U.S. PATENT DOCUMENTS

| | | | |
|---|---|---|---|
| 3,522,994 | 8/1970 | Zenkner | 415/914 |
| 3,684,396 | 8/1972 | Ball et al. | 415/914 |
| 4,006,997 | 2/1977 | Friberg et al. . | |
| 4,156,344 | 5/1979 | Cutbertson et al. . | |
| 4,212,585 | 7/1980 | Swarden et al. . | |
| 4,479,755 | 10/1984 | Skoe . | |
| 4,624,104 | 11/1986 | Stroem . | |

FOREIGN PATENT DOCUMENTS

| | | | |
|---|---|---|---|
| 32103 | 3/1977 | Japan | 415/914 |
| 705154 | 12/1979 | U.S.S.R. | 415/914 |
| 1040230 | 9/1983 | U.S.S.R. | 415/914 |
| 1108253 | 8/1984 | U.S.S.R. | 415/206 |

*Primary Examiner*—Edward K. Look
*Assistant Examiner*—Michael S. Lee
*Attorney, Agent, or Firm*—Gene E. Shook; Guy M. Miller; James A. Mackin

[57] ABSTRACT

The present invention is directed to a method and apparatus for improving the flow range in centrifugal pumps and compressors. Bleed holes are introduced into a volute tongue of a centrifugal pump or compressor thereby providing a double acting means of boundary layer control at the volute tongue.

10 Claims, 5 Drawing Sheets

METHOD OF REDUCING HYDRAULIC INSTABILITY

ORIGIN OF THE INVENTION

The invention described herein was made by employee of the U.S. Government and may be manufactured and used by or for the Government for governmental purposes without the payment of any royalties thereon or therefore.

FIELD OF THE INVENTION

The present invention is directed to reducing hydraulic instability thereby improving the flow range of a centrifugal pump or a centrifugal compressor. Features such as the design of a volute have primary influence on the stable operating flow range of a propellant-feed centrifugal turbopump in a rocket engine. New rocket engines for use in space which are fueled by propellants such as liquid hydrogen and oxygen will be expected to produce thrust from 20,000 to 50,000 lb. at their design points. In addition, engine throttling levels as low as five percent of design thrust can be anticipated in this new operating environment. Combustion chamber pressures for these high performance engines are anticipated to be near 1500 psia. Pressurization of the propellant to these high combustion chamber pressures will impose stringent requirements on turbopumps to provide high performance and a wide performance operating range that is free from stall and cavitation.

Compounding the problem of throttling over a broad operating range, most pump designs have focused on meeting the performance goals at a single point or within a narrow range. As a result, throttling the engine over a broad range requires a trade off between the performance of the engine and the design point.

In an attempt to address these stringent possibly competing requirements, more attention has been paid to the components of the centrifugal pump including the volute tongue. At off-design operating conditions conventional pumps are prone to flow separation. As this separation occurs, the volutes effectiveness in recovering static pressure deteriorates, reducing the overall efficiency and head produced by the pump stage. A reduction of the head at operating conditions below the design flow coefficient can cause the slope of the head-flow curve to become positive. A pump operating in the positive slope region of the head-flow curve can be prone to stall.

It is therefore an object of the present invention to extend the stall-free flow range of a centrifugal pumps and compressors.

It is a further object of this invention to decrease the flow separation from the volute encountered at off-design operating conditions.

DESCRIPTION OF THE RELATED ART

Friberg et al U.S. Pat. No. 4,006,997 is directed to turbomachinery operating over a variable range. Cuthberstson et al U.S. Pat. No. 4,156,344 is directed to an improvement to a turbofan engine intended to reduce fan noise. Swarden et al U.S. Pat. No. 4,212,585 is directed to an improvement for extending the stable operating range of a centrifugal compressor.

In Shoe U.S. Pat. No. 4,479,755 acoustically sized bleed passages are provided in the shroud wall of a rotary compressor to admit expansion waves to the suction-sides of successive passing blades to control the boundary layer. Stroem U.S. Pat. No. 4,624,104 is directed to an aerodynamically shaped air flow deflector used in a turbine having a small diameter bleed hole which facilitates the maintenance of air flow over varying ranges of operation.

SUMMARY OF THE INVENTION

The present invention is directed to a method of increasing the throttling range of an engine by improving the flow range of the centrifugal pumps within the engine. The multistage pump in the present invention is composed of both a hydrogen and an oxygen centrifugal pump. Using the present invention 20% throttling of the design flow coefficients of the pumps is achieved when the engine goes to 5% of the engine design thrust. At the design thrust the flow passing the tongue would be 7.5 lbs/sec of liquid hydrogen and 45 lbs/sec of liquid oxygen. The output pressure of each of these pumps would average about 2100 psia. When the engine is throttled to a lower level of thrust (e.g.: 50% of design thrust), both the hydrogen and oxygen pumps will operate at reduced flow coefficients (20% of design flow coefficient).

Applications of this pump include its use in any pump or compressor having a volute, in all industrial and aerospace turbomachinery, ranging from axial to centrifugal configurations, where throttling is essential. The fixed geometry of the volute tongue is shaped to provide zero incidence with the flow angle that exits from the rotor during time averaged steady-state operation, at the design flow coefficient. At zero incidence, the static pressure differential between the suction and pressure surfaces is nearly zero. However, a pump in a throttleable rocket engine system is also required to operate at off-design flow coefficients. During operation at off-design conditions, the time averaged incidence angle at the tongue becomes non-zero and can experience large variations in the positive and negative directions. At flow coefficients higher than the design value, the flow angle becomes more nearly radial, creating an incidence angle with the volute tongue. Likewise, at flow coefficients lower than the design value, the flow angle becomes nearly tangential and creates an incidence angle on the opposite side of the tongue. In a conventional volute, increased range of incidence due to pump operation on either side of the design point ultimately results in flow separation at the volute tongue and loss of performance. There is also a pressure differential at off design incidence between the inner surface and the outer surface of the volute tongue. This invention proposes to take advantage of this pressure differential by using the differential to control the boundary layer near the tongue thereby preventing flow separation.

The pressure differential that is caused by the incidence at off design operation creates a force that drives the boundary layer fluid through the bleed holes. Whether there is positive or negative incidence, the direction of bleed flow is always from high pressure to low pressure. In this way, the bleed holes provide a passive self-correcting, double-acting, means of boundary layer control, by providing communication between the inner and outer surfaces of the volute tongue. This in turn delays flow separation from occurring through an improved range of pump operation.

BRIEF DESCRIPTION OF THE DRAWINGS

The advantages and novel features of the invention will be more fully apparent from the following detailed description when read in connection with the accompanying drawings in which.

DESCRIPTION OF THE PREFERRED EMBODIMENT

Figure 1:
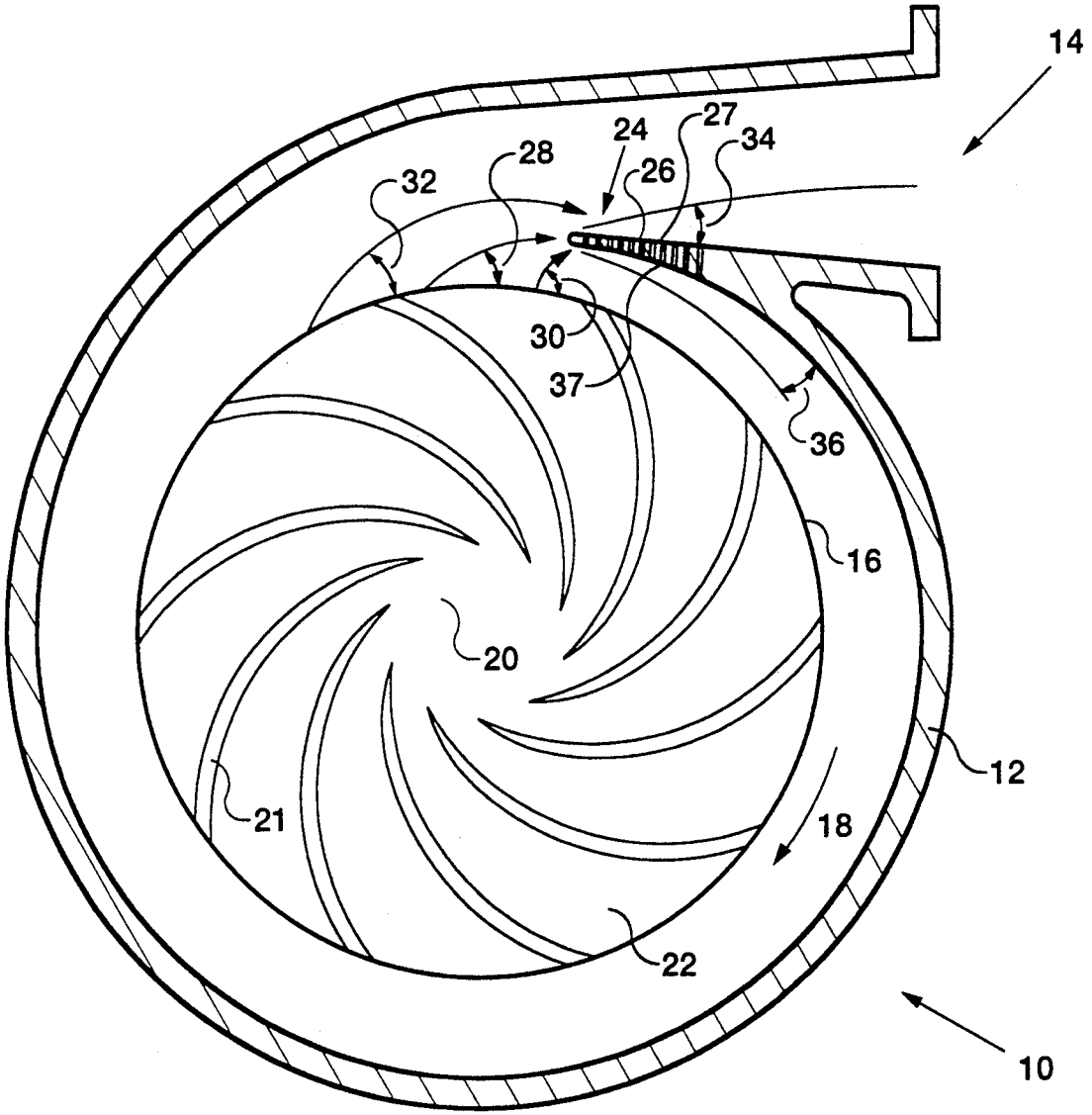
FIG. 1 displays a sectional view across the axis of a single centrifugal pump with a volute.

A section across the axis of a single-suction volute pump is displayed in FIG. 1. The volute pump 10 includes a volute casing 12 which has a formed discharge area 14 for the expulsion of fluid forced against the casing 12 by centrifugal force. An impeller 16 located in the center of the volute casing 12 rotates in a clockwise direction as prescribed by 18. This rotating action creates suction at the head of the impeller 20 thereby drawing fluid through passageways 22 located in the impeller 16. The rotation of the impeller also creates a centrifugal force which drives the fluid against the wall of the casing 12.

Located at the throat of the pump discharge area 14 is a volute tongue 24 including an outer surface 27, an inner surface 37 and bleed holes 26 located therein. When the impeller 16 operates at design conditions flow forced away from the rotating impeller by centrifugal force impinges on the volute tongue at the design angle 28 and no flow separation occurs. However, when the engine is throttled to a high percent of design thrust or throttled to a low percent of design thrust the angle at which the flow from the impeller impinges the volute tongue changes, and flow separation due to incidence occurs.

When the engine is throttled down to a low percentage of thrust, the flow coming off of the impeller 16 impinges the volute tongue 24 at an angle 32 below the design angle 28. This creates an incidence which ultimately results in flow separation 36 on the inner surface 37 of the volute tongue. This flow separation 36 also creates a higher pressure on the inner surface 37 of the volute than on the outer surface 27 of the volute. This pressure difference and flow separation would be maintained in a centrifugal pump in the prior art.

According to the present invention, the introduction of the bleed holes 26 in the volute tongue 24 offers a means of controlling the boundary layer by using the pressure difference between the outer surface 27 and inner surface 37 of the tongue. The lower pressure on the outer surface 27 of the tongue will create suction, pulling the boundary layer flow that has separated from the inner surface 37 of the tongue thereby providing laminar flow control of fluid against both the outer surface 27 and the inner surface 37 of the volute tongue 24.

When the engine is throttled to a higher percentage of design thrust the flow leaving the impeller impinges the volute tongue 24 at an angle 30 which is higher than the design angle 28. This causes a high incidence angle which ultimately results in flow separation 34 on the outer surface 27 of the volute tongue 24.

This also creates a high pressure region on the outer surface 27 of the volute tongue relative to the pressure at the inner surface 37 of the tongue. However, as a result of the bleed holes 26 located in the volute tongue 24 the pressure on the outer surface 27 and inner surface 37 of the volute attempt to equalize causing some of the boundary layer flow at 34 to be sucked through the bleed holes thereby creating laminar flow on both the outer surface 27 and the inner surface 37 of the volute tongue.

As a result, the bleed holes 26 located in the volute tongue 24 serve as a two-way self correcting implementation which enables a broader range of throttling capabilities before flow separation occurs. The laminar flow in turn creates greater efficiency due to improved pressure recovery in the volute throughout an increased flow range of the pump.

Figure 2:
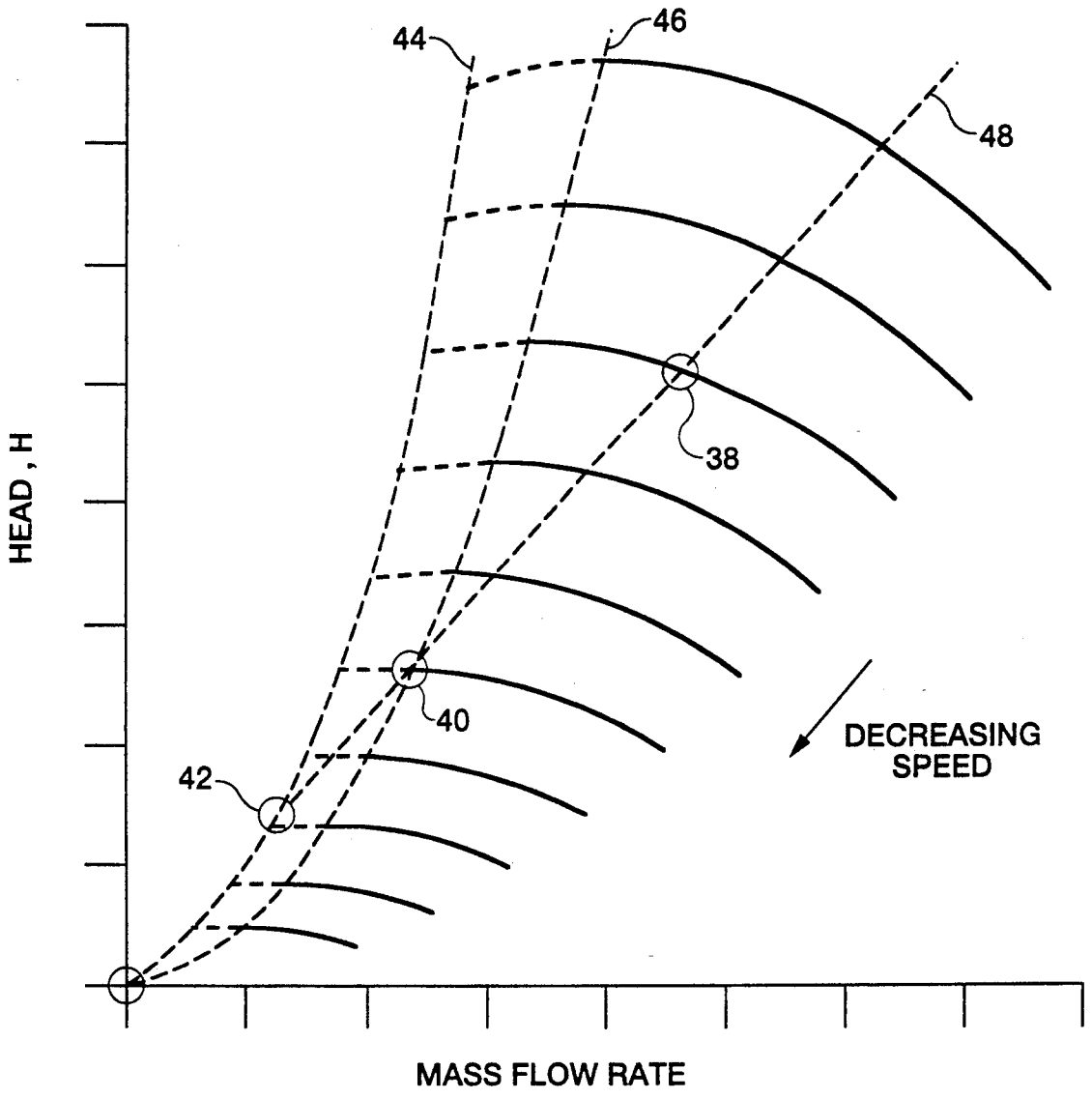
FIG. 2 displays a graph of the pump flow rate versus the head to display the improved engine throttle line.

FIG. 2 displays a graph of the pump head versus the flow rate. The normal surge line 46 shows the current limit of stable stall-free operation of a typical high-head pump. In a rocket engine, as the thrust is reduced from the design point 38 by throttling down to a lower percentage of design thrust, the rotative speed and flow through the pump are reduced disproportionately due to system constraints. It is disproportionate reduction of the pump's speed and flow during throttling down that causes the engine throttle line 48 to cross the surge line 46 at point 40. Point 40 shows the normal limit of engine throttling with current pump technology. However, with the addition of the bleed holes in the volute tongue, the surge line shifts to 44 enabling the engine to throttle down to a lower thrust level at a location 42. As a consequence, the throttling capability is now expanded to the point located at 42 which represent the new off-design throttling capability of the engine.

Figure 3:
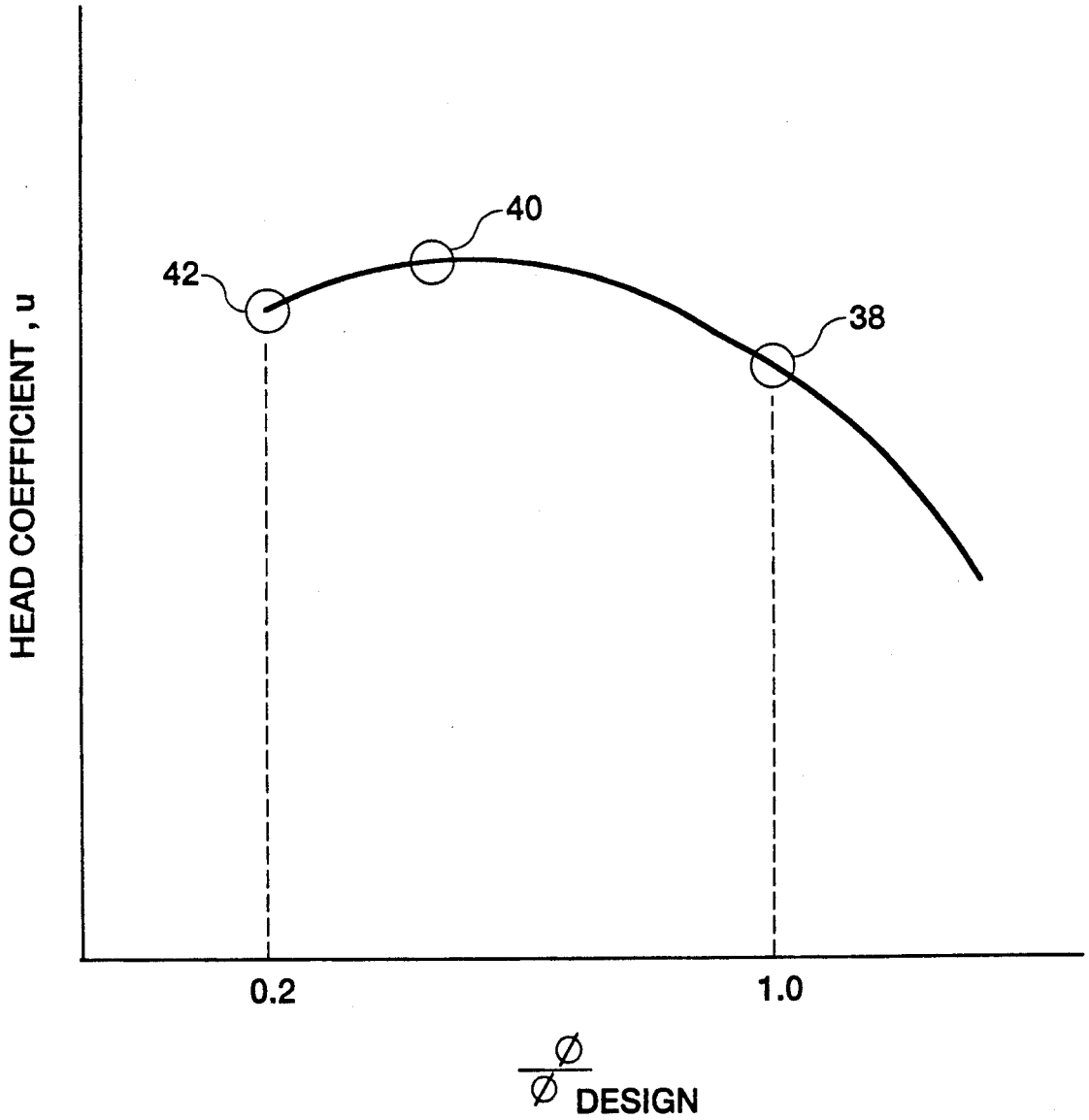
FIG. 3 displays a normalized pump head-flow map: ratio of the operating flow coefficient to design flow coefficient ($\phi/\phi$ design) versus the head coefficient.

FIG. 3 displays the pump's head coefficient versus $\phi/\phi$ design. This graph also displays the pump's design point 38 and the increased throttling capability caused by the bleed holes at point 42 over the normal surge at 40. Other factors such as fluid pressure and temperature at the pump inlet can influence the location of the surge line. A condition known as cavitation surge can be created by unfavorable fluid conditions upstream of the pump. In a normal pump surge is encountered typically between 50% and 80% of the design flow coefficient. In this graph the head coefficient is defined as the ratio of the head produced by the pump to the square of the peripheral speed of the impeller tip. Flow coefficient is defined as the ratio of flow to pump shaft speed.

Figure 4:
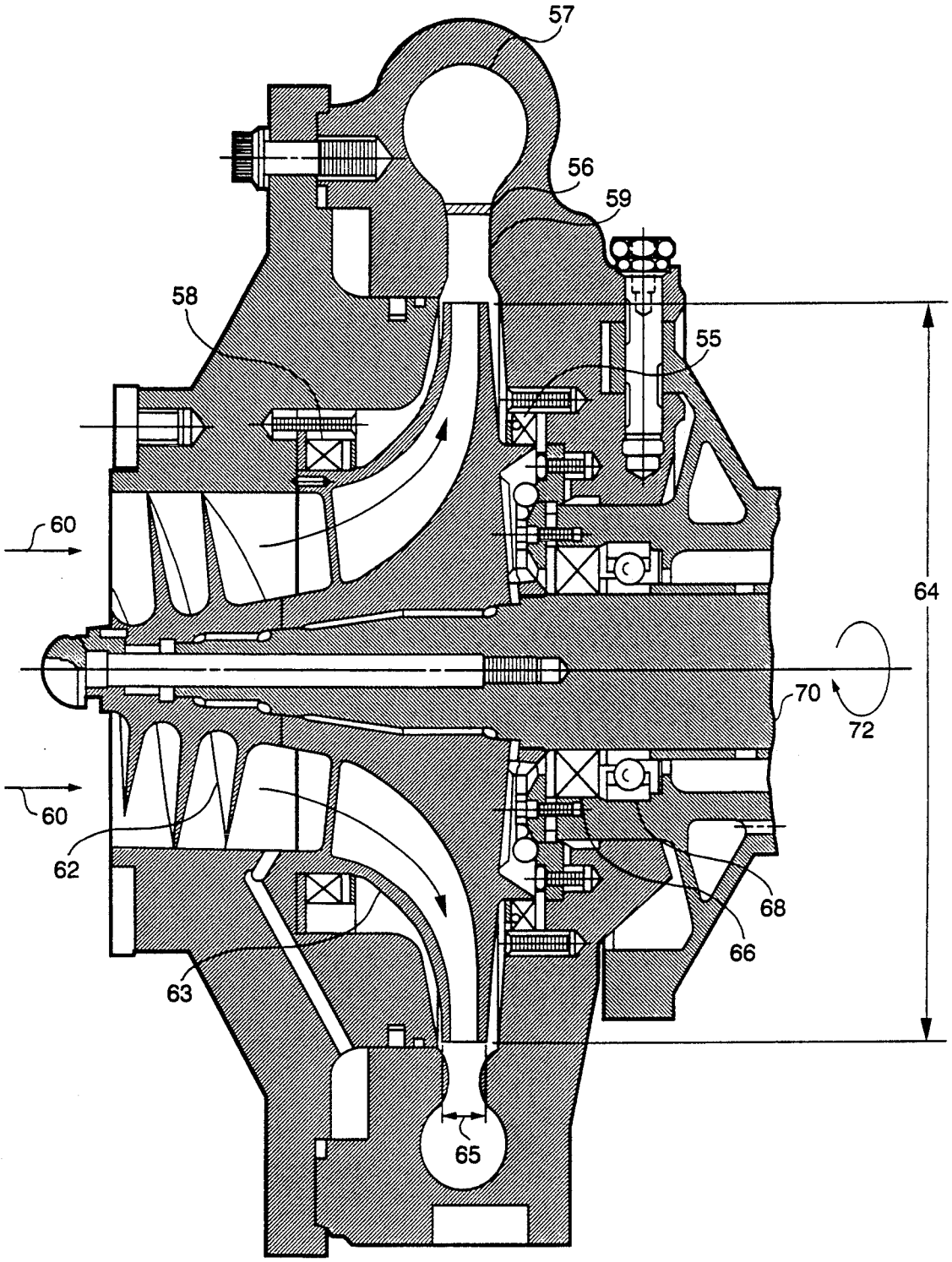
FIG. 4 displays a meridional view of a single centrifugal pump with a volute.

FIG. 4 displays a meridional view of a simple centrifugal pump with a volute. A pump inducer 62 receives the pump inlet mass flow 60, which flows through the blades of the pump impeller 63 and exits the impeller at the discharge diameter 64 and exit height 65. The flow then goes through the vaneless difusser 59, and ultimetely flow past the volute tongue 56 and exits the pump through the volute 57. Internal leakage is minimized by the impeller front 58 and rear 55 cover seals. Velocity gradients and pressure pulsations with the flow are minimized at the vaneless diffuser 59.

The inducer 62 receives fluid entering the impeller 63 and adds work to the fluid in order to minimize impeller cavitation and improve suction performance. Shaft bearings 68 take up the axial and radial loads on the impeller, while the shaft seals 66 prevent fluid from escaping from the pump case.

The impeller 63 is driven by a drive shaft 70 which has a pump shaft rotation speed magnitude and the direction denoted by 72.

In a rocket engine system, several stages of centrifugal pumps, each pumping various working fluids and having various pump dimensions may be incorporated. For example, for a pump described in FIG. 4, fluids such as liquid oxygen, hydrogen or water may be used. With each of these working fluids several dimensions of the pump, such as the pump inducer 62 inlet diameter pump impeller discharge diameter 64, and impeller exit height 65, would change to accommodate the performance characteristics required with the different fluids. Along with these the drive shaft 70 speeds in rpm denoted by 72 would change to drive the pump inlet mass flow 60 entering the inducer at 62.

In the case of a liquid hydrogen pump an inducer inlet diameter of 2.4", a pump impeller discharge diameter of 4.4", and an impeller exit height of 0.10", would require a 100,000 RPM rotation of a drive shaft to produce a pump inlet mass flow of 7.5 lbs/sec and an exit pressure of 2100 psia. A liquid oxygen pump would use an inducer inlet diameter of 1.8", a pump impeller discharge diameter of 2.8" and an impeller exit height of 0.14" to have an inlet mass flow of 45. lbs/sec and an exit pressure of 2100 psia when the drive shaft is rotating at 48000 rpm. Finally, in a research, or industrial pump that uses water; a drive shaft rotating at 3450 rpm would bring 150 lbs/sec of flow into an inducer having an inlet diameter of 8.3", a pump impeller discharge diameter of 15.3", and an impeller exit height of 0.347". The exit pressure of this single stage water pump would be 400 psia.

ALTERNATE EMBODIMENT

The bleed holes 26 located in FIG. 1, serve as a double action self correcting passageway for controlling the boundary layer flow and turbulence intensity on both the outer surface 27 and inner surface 37 of the volute tongue.

Figure 5:
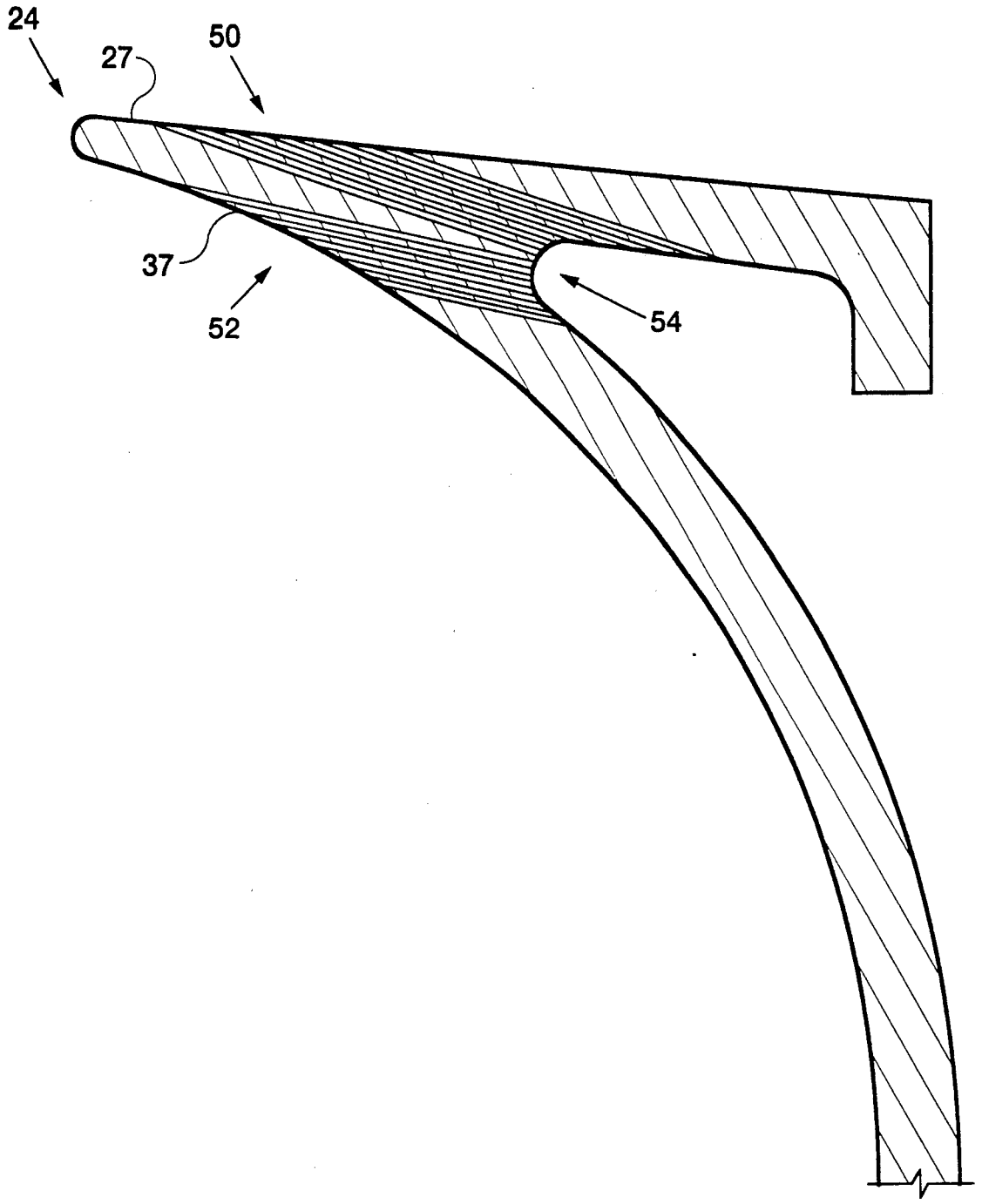
FIG. 5 displays an enlarged view of the volute tongue, with bleed holes directed to a lower pressure region elsewhere in the pump stage or rocket engine system.

However, flow turbulence can also be reduced by providing passageways in the volute to another lower pressure area of the turbomachine. FIG. 5. displays one of several embodiments that accomplish this objective. In one of the alternate embodiments the volute tongue 24 has two sets of passageways of bleed holes 50 and 52. The bleed holes denoted by 50 bleed off the separated boundary layer flow from the outer surface 27 of the volute to a lower pressure area denoted by 54. In a similar manner, flow separation on the inner surface 37 of the volute is bled off using the passageways 52, which carry the flow to a lower pressure area 54. Unlike the preferred embodiment the bleed holes in the inner surface 27 and the outer surface 37 of the volute do not communicate. Instead they communicate with a lower pressure region located elsewhere in the engine. Although the bleed holes do not communicate with each other directly, because of the fact that they both communicate with a lower pressure region the bleed holes 50 and 52 still serve as a double acting turbulent boundary layer flow control implementation.

While several embodiments of the invention are disclosed and described it will be apparent that various modifications may be made without departing from the spirit of the invention of the scope of the subjoined claims.

What is claimed is:

1. A method of reducing hydraulic instability thereby extending the stall-free range of a centrifugal turbomachine including a volute casing having a discharge area therein, an impeller and a volute tongue having an outer surface and an inner surface, said method comprising the steps of:

introducing passageways in said volute tongue thereby placing said outer surface in communication with said inner surface, increasing throttle in said centrifugal turbomachine whereby flow impinges said volute tongue at a high angle of incidence thereby creating boundary layer flow separation and high pressure at said outer surface of said volute tongue and a low pressure at said inner surface of said volute tongue. decreasing said boundary layer flow separation by using said low pressure to create suction whereby flow is sucked through the passageways in said volute tongue to the inner surface thereby forming laminar flow from said boundary layer flow separation on said outer surface of said volute tongue, decreasing throttle in said centrifugal turbomachine whereby flow impinges said volute tongue at a low angle of incidence thereby creating boundary layer flow separation and high pressure on said inner surface of said volute tongue and low pressure on said outer surface of the volute tongue, and decreasing said boundary layer flow separation at said inner surface of the volute tongue by using said low pressure to creating suction whereby flow is sucked through the passageways in said volute tongue to the outer surface thereby forming laminar flow from said boundary layer flow separation at the inner surface of said volute tongue.

2. A method as claimed in claim 1 wherein the engine thrust is throttled to about 5% of the design thrust.

3. A method as claimed in claim 2 wherein said centrifugal turbomachine flow coefficient is about 20% as said engine system is throttled to a lower-percent of design thrust.

4. A method as claimed in claim 2 wherein said centrifugal turbomachine flow-coefficient is about 110% of design flow coefficient as said engine system is throttled to a higher percent of design thrust.

5. A method as claimed in claim I wherein said turbomachine output pressure at said discharge area is about 2100 psia at the engine system design operating point.

6. A method as claimed in claim 1 wherein said flow is composed of liquid hydrogen.

7. A method as claimed in claim 1 wherein said flow moves past said volute tongue at a rate of 7.5 lbs/sec.

8. A method as claimed in claim 1 wherein said flow is composed of liquid oxygen.

9. A method as claimed in claim 8 wherein said flow goes past said volute tongue at a rate of 45. lbs/sec.

10. A method of reducing boundary layer flow separation in a centrifugal turbomachine including a volute tongue, said volute tongue including an outer surface and an inner surface, connected by at least one passageway, said method comprising:

creating a high pressure area and boundary layer flow separation on said inner surface of said volute tongue, and decreasing said boundary layer flow separation by providing a low pressure area in communication with said high pressure area on said inner surface of said volute tongue whereby suction is created thereby sucking the boundary layer flow separation through said at least one passageway to said lower pressure area.

* * * * *